US005599120A

United States Patent [19]

Conrad et al.

[11] Patent Number: 5,599,120

[45] Date of Patent: Feb. 4, 1997

[54] ADAPTER FOR INK JET PRINTING ONTO ADHESIVE BINDING TAPE

[75] Inventors: Charles E. Conrad, Scottsville; William A. Sullivan, Rochester; Robert A. Coons, Bloomfield, all of N.Y.

[73] Assignee: Xerox Corporation, Stamford, Conn.

[21] Appl. No.: 130,808

[22] Filed: Oct. 4, 1993

[51] Int. Cl.[6] ..... B41J 11/58

[52] U.S. Cl. ..... 400/624; 400/521; 400/625; 347/101; 271/145; 271/207; D18/44; D18/49; D18/56

[58] Field of Search ..... 400/521, 522, 400/536, 537, 538, 539, 540, 541, 542, 543, 605, 624, 625, 626; 347/101, 103, 104, 106; 271/145, 162, 163, 169, 171, 207; 355/311, 321; D20/40, 41, 43; D25/119, 121; D18/44, 49, 56; D7/631, 632; 248/127

[56] References Cited

U.S. PATENT DOCUMENTS

| | | | |
|---|---|---|---|
| 4,625,641 | 12/1986 | Jagosz et al. | 400/624 |
| 4,728,963 | 3/1988 | Rasmussen et al. | 346/25 |
| 4,774,530 | 9/1988 | Hawkins | 346/140 |
| 4,794,859 | 1/1989 | Huseby et al. | 400/625 |
| 4,844,633 | 7/1989 | Greenberg | 400/625 |
| 5,000,596 | 3/1991 | Naruki | 400/625 |
| 5,106,051 | 4/1992 | Jondelius | 400/624 |
| 5,172,138 | 12/1992 | Okazawa et al. | 347/104 |
| 5,287,164 | 2/1994 | Watanabe | 271/145 |
| 5,336,004 | 8/1994 | Harada et al. | 400/624 |

FOREIGN PATENT DOCUMENTS

| | | | |
|---|---|---|---|
| 498561 | 8/1992 | European Pat. Off. | 400/624 |
| 2632566 | 12/1989 | France | 347/101 |
| 59-203023 | 11/1984 | Japan | 271/145 |
| 02-018230 | 1/1990 | Japan | 271/145 |

*Primary Examiner*—David A. Wiecking
*Attorney, Agent, or Firm*—William R. Heary, II

[57] ABSTRACT

A thermal ink jet printer that prints onto thermal adhesive binding tape includes a tape feeding adapter that enables the feeding of tape into and out of the printer. The adapter includes a base support member for supporting a plurality of tapes in a substantially horizontal position for feeding into the printer and two tape guide members positioned orthogonally and centrally of the base support member for guiding the tapes into and out of the printer. Two support and guide members are connected to and extends orthogonally with respect to the two tape guides members for receiving and supporting the tapes between the two tape guides members and above the base support member after the tapes have exited the printer.

15 Claims, 3 Drawing Sheets

ADAPTER FOR INK JET PRINTING ONTO ADHESIVE BINDING TAPE

BACKGROUND OF THE INVENTION

This invention relates to thermal ink jet printing and, more particularly, to thermal ink jet printing of images onto thermal adhesive binding tape.

A thermal ink jet printer has at least one printhead in which thermal energy pulses are used to produce vapor bubbles in ink-filled channels and so cause droplets of ink to be expelled from the channel orifices towards a recording medium. The thermal energy pulses are usually produced by resistors, each located in a respective one of the channels, which are individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink which forms a droplet moving in a direction away from the channel and towards the recording medium. The channel is then re-filled by capillary action, which in turn draws ink from a supply container. Some arrangement is usually provided to clean the channel orifices periodically while the printhead is in use and to close-off the orifices when the printhead is idle to prevent the ink in the printhead from drying out.

One form of thermal ink jet printer which is incorporated herein by reference to the extent necessary to practice the present invention is described in U.S. Pat. No. 4,728,963 which provides both a paper supply tray and a paper collection tray in the front of the printer for ease of handling and reduced footprint. The paper collection tray is provided with a pair of opposed output rails which support a sheet during printing to permit ink printed onto a sheet or paper previously to dry. A paper handling mechanism is provided which picks off a sheet of paper from a stack and brings it around paper drive rollers onto a platen where the printing operation, employing a printhead cartridge occurs. One problem with this type of paper supply mechanism is the absence of a means to feed thermal binding tape strips for printing thereon by the printer. This problem is particularly acute since thermal adhesive binding tape is an industry approved method of producing small quantities of bound books. Some of the approved systems use precut 11" tape strips for book binding purposes that are about 1" to 3" in width.

SUMMARY OF THE INVENTION

It is an object of the present invention to provide a system by which books assembled with thermal adhesive binding tape can have the spine of the book labeled with the title, author, etc.

Accordingly, in the present invention, an auxiliary, modular, tape feed adapter for a thermal ink jet printer is provided that enables the printer to print onto thermal adhesive binding tape strips. The adapter includes an 8½"×11" base with Two sets of guides positioned approximately center of the base for supporting and guiding thermal binding tape strips into and out of the ink jet printer in order to receive labeling thereon.

BRIEF DESCRIPTION OF THE DRAWINGS

By way of example, an embodiment of the invention will be described with reference to the accompanying drawings, in which like parts have the same index numerals and in which.

DESCRIPTION OF THE PREFERRED EMBODIMENT

Figure 1:
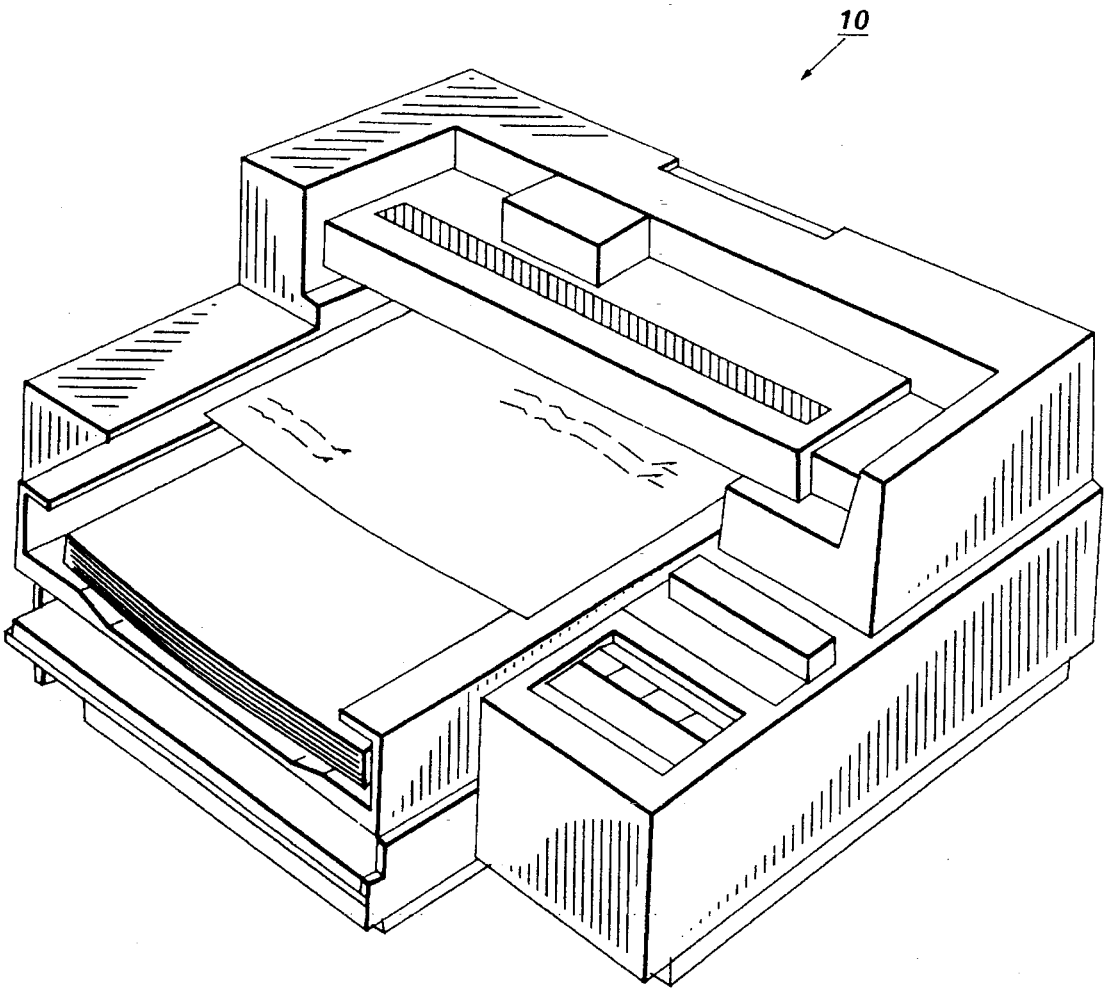
PRIOR ART FIG. 1
FIG. 1 is a schematic isometric view of a prior art thermal ink jet printer showing a conventional paper supply and receiver.

Conventionally, a thermal ink jet printer 10 is shown in FIG. 1 that contains several disposable ink supply cartridges (not shown), each with an integrally attached printhead that preferably contains black ink. Optionally, each of the cartridges or any one of them may be resupplied with ink from a fixed ink supply at a remote location within the printer. The ink cartridge and printhead combination are removably mounted on a translatable carriage disposed in a printing zone adjacent the periphery of a cylindrical platen assembly. During the printing mode, the carriage confrontingly reciprocates back and forth on, for example, on guide rails, parallel to the surface of the cylindrical platen assembly. The cylindrical platen assembly has a diameter of between 10 and 20 cm and is constructed, for example, out of a plastic sleeve having a wall thickness of 3 to 6 mm, with dust proof end caps containing a mounting shaft. One end of the shaft may be driven by a pulley and timing belt by a stepping motor. The cylindrical platen assembly is rotatably mounted in frame sides which also contain the ends of the guide rails. The carriage is driven back and forth across the length of the cylindrical platen assembly by well known means such as, for example, by cable and pulley with a reversible motor.

Usually, a recording medium, such as, paper, is fed from a cassette in cut sheet form to the cylindrical platen assembly where the recording medium is registered with the printing zone and firmly thereon by means well known in the art such as, rolls, gripper bars, star wheels, or a vacuum through vacuum ports. The printhead has a linear vertical array of nozzles which define the height of a swath of information printed by the translation of the printhead on the carriage. For a detailed description of a typical thermal ink jet printhead refer to U.S. Pat. No. 4,774,530 to Hawkins or U.S. Pat. No. 4,728,963 to Rasmussen et al, both of which are incorporated herein by reference. After each swath of information is printed, the cylindrical platen assembly is stepped about its axis for the distance equal to the height of one printed swath in a counter clockwise direction. Thus, the printing zone is that space on the cylindrical platen assembly equal to a printable swath by the printhead. After the recording medium has been printed, one swath at a time until the entire recording medium has been covered, it is directed to a tray located above the sheet input cassette.

Figure 2:
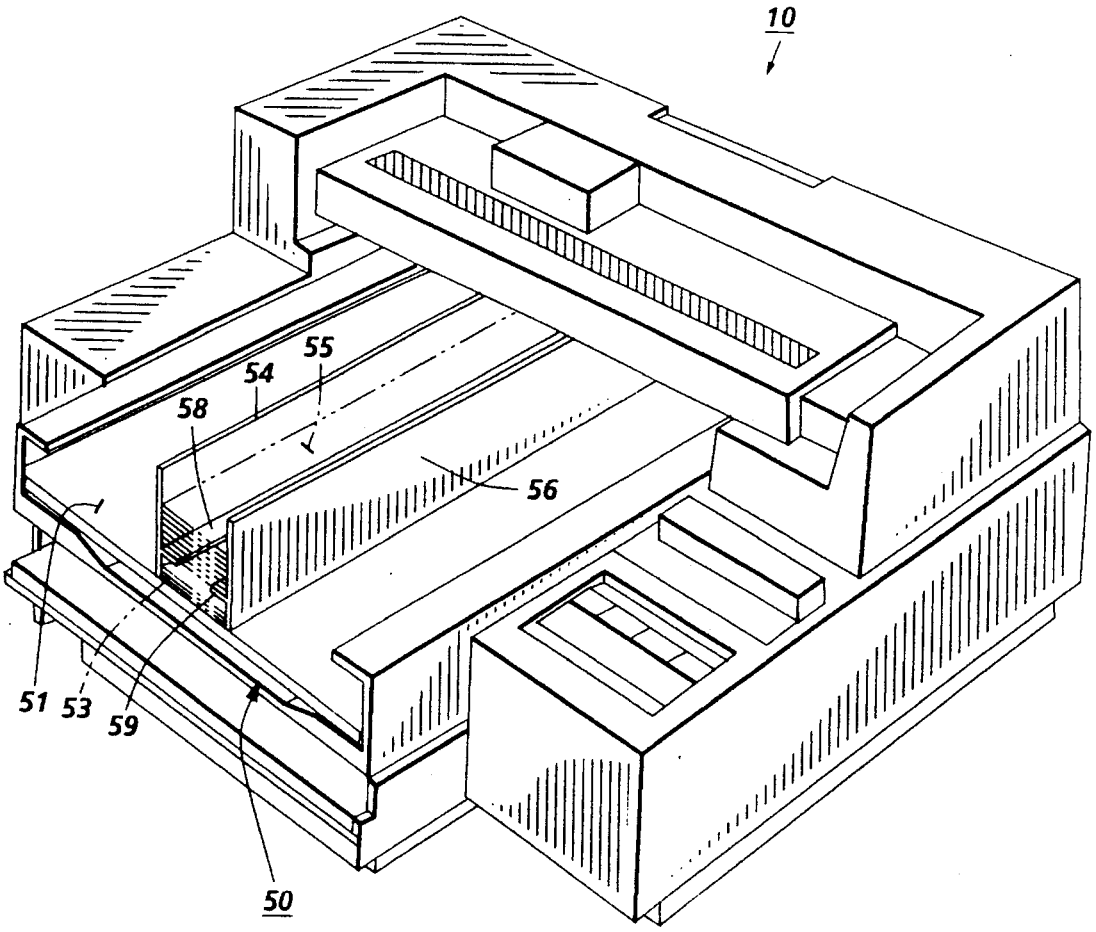
FIG. 2 is a schematic isometric view of the printer of FIG. 1 with the thermal adhesive binding tape adapter of the present invention incorporated therein.
Figure 3:
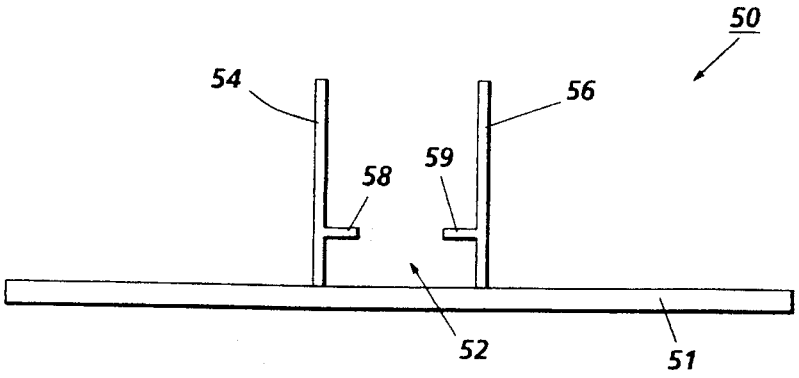
FIG. 3 is an enlarged schematic end view of the thermal adhesive binding tape adapter of FIG. 2.
Figure 4:
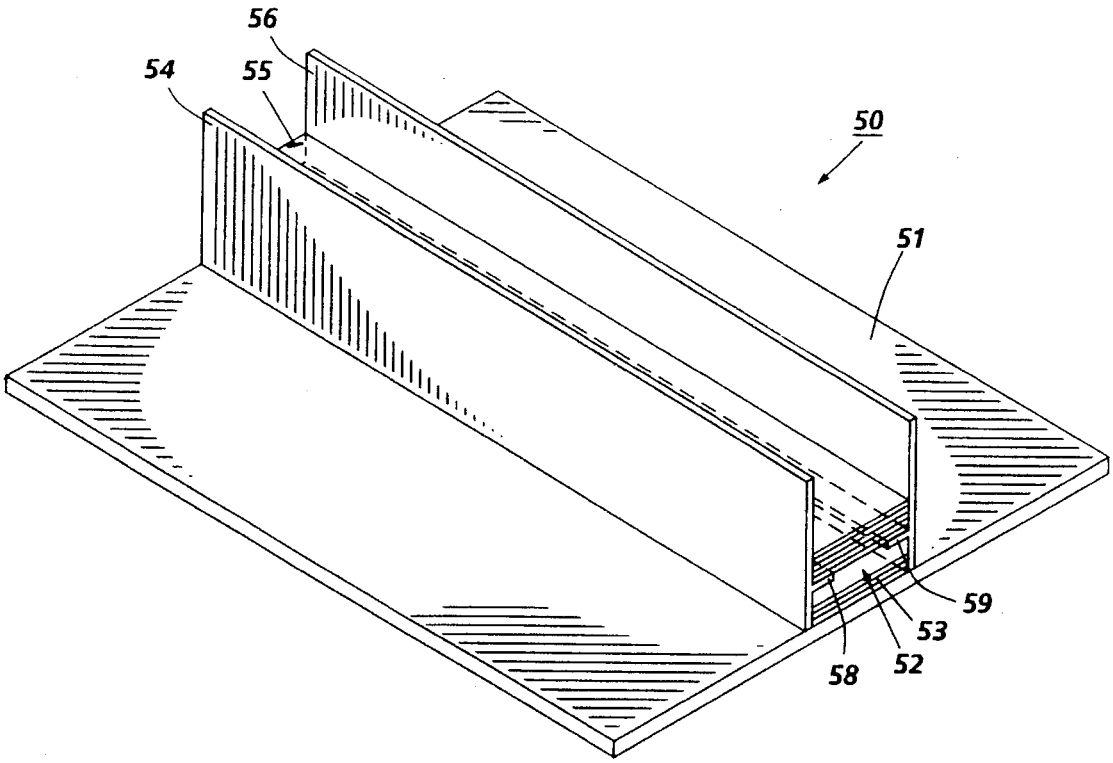
FIG. 4 is an enlarged partial schematic isometric view of the thermal adhesive binding tape adapter of FIG. 3 showing binding tape in the input and output compartments of the adapter.

Printers of this type are fine for printing full widths of 8½"×11" pages fed from a cassette or a platform, however, these printers are not capable of printing onto thermal adhesive binding tape (e.g., the 1"×11" sample enclosed herewith) that is used to cover the spine of printed books because the binding tapes are usually much narrower widths (e.g., 1"–3") than the trays and cassettes presently used for paper feeding. To answer this need for a modified sheet feeding mechanism, an auxiliary, modular, tape feed adapter 50 is shown in FIGS. 2–4 for use with a conventional thermal ink jet printer that will enable the printer to print onto narrow thermal adhesive binding tape strips, e, widths less than 8½". The adapter comprises an 8½"×11" base 51 with two guides 54 and 56 positioned approximately center of the base for supporting and guiding thermal binding tape strips into and out of the ink jet printer in order to receive labeling thereon. The guides 54 and 56 define the width of tapes that are to be fed and can be made adjustable to fit a wide variety of tape widths, if desired. For example, the guides could be mounted on slides that would allow the guides to move laterally to adjust for different tape widths. The central positioning of the guides place the tapes centrally of the printer platen and through appropriate software facilitates the printing of the tapes without having the printhead to move back and forth the full width of the platen. Microsoft Word and Windows 3.1 has the range of sizes and faces of fonts and control over print placement and orientation to make this an effective platform for controlling printing of the printer as required.

As seen in FIGS. 2–4, tape return support and guide platforms 58 and 59 are connected to and positioned orthogonally with respect to upstanding guide walls 54 and 56. These platforms are adapted to serve as guide and support members for printed tapes exiting the platen of the printer. Guide and support members 58 and 59 are positioned above and area 52 within walls 54 and 56 that houses blank tapes 53 for feeding into the printer for printing.

In operation, tape feeder adapter 50 is loaded with thermal adhesive binding tape into area 52 of the adapter below guide and support members 58 and 59 and placed into the cavity of a printer that is usually occupied by either a sheet feed cassette or a paper tray or is placed directly onto the sheet support surface of the paper feed tray. Actuation of the printer causes the tapes to be fed by the feed mechanism of the printer individually into the printer for printing of customized information thereon, such as, the title of a book, the author, etc. The paper feed mechanism feeds the now printed tapes out of the printer between walls 54 and 56 and the tapes drop due to gravity onto guide and support members 58 and 59 for pickup by an operator. Thus, a tape feed adapter for a thermal ink jet printer is provided that enables the printer to print onto thermal adhesive binding tape strips. The adapter includes an 8½"×11" base with Two sets of guides positioned approximately center of the base for supporting and guiding thermal binding tape strips into and out of the ink jet printer in order to receive labeling thereon.

Many modifications and variations are apparent from the foregoing description of the invention and all such modifications and variations are intended to be within the scope of the present invention.

We claim:

1. An ink jet printer adapted to print onto thermal adhesive binding tape, comprising:

a sheet input tray including a sheet support portion;

a thermal adhesive binding tape feeding adapter that cooperates with said sheet support portion of said sheet input tray in the feeding of said thermal adhesive tape into and out of the printer, said adapter including a base support member configured to fit on top of and touchingly contact said sheet support portion of said sheet input tray of the printer and adapted to support a plurality of narrow width thermal adhesive binding tapes in a substantially horizontal position for feeding into the printer; two tape guide members positioned orthogonally and centrally of said base support member for guiding said thermal adhesive binding tapes into and out of the printer; and at least two support and guide members connected to and extending orthogonally with respect to said two tape guides members for receiving and supporting said thermal adhesive binding tapes between said two tape guides members and above said base support member after said thermal adhesive binding tapes have exited the printer and feeder means for feeding said thermal adhesive binding tape from said tape feeding adapter into and out of the printer.

2. The ink jet printer of claim 1, wherein said at least two support and guide members are discontinuous between said two tape guides members.

3. The ink jet printer of claim 2, wherein the printer includes a sheet holding cassette having a sheet supporting surface.

4. The ink jet printer of claim 3, wherein said base support member of said tape feeding adapter is configured to be placed on top of said sheet supporting surface of said cassette.

5. The ink jet printer of claim 4, wherein said sheet supporting surface of sad sheet holding cassette is configured to hold 8½"×11" copy sheets with side portions extending orthogonally thereto and said base support member of said tape feeding adapter is adapted to be placed on top of said sheet supporting surface of said cassette and directly adjacent said side portions of said cassette.

6. The ink jet printer of claim 3, including thermal adhesive binding tapes, and wherein said thermal adhesive binding tapes have a width of from about 1" to about 3".

7. An arrangement that enables the printing of thermal adhesive binding tape by an ink jet printer, comprising:

a sheet input tray including a sheet support portion;

an adapter having a base support member configured to fit on top of and touchingly contact said sheet support portion of said sheet input tray and adapted to support a plurality of narrow width thermal adhesive binding tapes in a substantially horizontal position for feeding into the printer;

two tape guide members positioned orthogonally and centrally of said base support member for guiding the tapes into and out of the printer; and at least two support and guide members connected to and extending orthogonally with respect to said two tape guides members for receiving and supporting the tapes between said two tape guides members and above said base support member after the tapes have exited the printer.

8. The adapter of claim 7, wherein said at least two support and guide members are discontinuous between said two tape guides members.

9. The adapter of claim 1, including thermal adhesive binding tapes, and wherein said thermal adhesive binding tapes have a width of from about 1" to about 3".

10. A modular auxiliary module adapted to be placed into the sheet feeding position of an ink jet printer for feeding thermal adhesive binding tape into the printer and receiving the binding tape exiting the printer, comprising:

a thermal adhesive binding tape feeding adapter that enables the feeding of thermal adhesive binding tape into and out of the printer, said adapter including a base support member configured to fit on top of and touchingly contact a sheet support portion of a sheet input tray of the printer for supporting a plurality of narrow width thermal adhesive binding tapes in a substantially horizontal position for feeding into the printer; two tape guide members positioned orthogonally and centrally of said base support member for guiding thermal adhesive binding tapes into and out of the printer, said two tape guide members having continuous, smooth tape contacting surfaces throughout thereof that form a channel into which the thermal adhesive binding tapes are placed for feeding into the printer; and at least two support and guide members connected to and extending orthogonally with respect to said continuous, smooth tape contacting surfaces of said two tape guide members and into said channel for receiving and supporting thermal adhesive binding tapes between said two tape guides members and above said base support member after thermal adhesive binding tapes have exited the printer.

11. The modular auxiliary module of claim 10, wherein said at least two support and guide members are discontinuous between said two tape guides members.

12. The modular auxiliary module of claim 10, wherein blank tapes are positioned below said at least two support and guide members and printed tapes are placed above said two tape guides members.

13. The modular auxiliary module of claim 10, including thermal adhesive binding tapes, and wherein said thermal adhesive binding tapes have a width of from about 1" to about 3".

14. A media holder in the form of a modular, operator installable, thermal adhesive binding tape feed and receipt device adapted to be inserted onto and in direct contact with a sheet support surface of a sheet input tray of an ink jet printer, and characterized in that said device is portable, has a first feed tray for feeding said thermal binding tape into the printer and a second tray for receiving said thermal binding tape exiting the printer, said device having guide members having continuous, smooth tape contacting surfaces throughout thereof that form a channel into which the thermal adhesive binding tapes are placed for feeding into the printer and including and at least two support and guide members connected to and extending orthogonally with respect to said continuous, smooth tape contacting surfaces of said guide members and into said channel for receiving and supporting thermal adhesive binding tapes between said guide members and above a base support member after thermal adhesive binding tapes have exited the printer, and wherein said guide members are adapted to facilitate the feeding of thermal adhesive binding tapes having a width of from about 1" to about 3".

15. A media holder of claim 14, wherein said guide members are spaced no less than about 1" and no more than about 3" away from a centerline through the width of a tape support surface of said media holder.

* * * * *